US005747237A

United States Patent [19]

Fukui et al.

[11] Patent Number: 5,747,237

[45] Date of Patent: May 5, 1998

[54] SILVER HALIDE PHOTOGRAPHIC MATERIAL

[75] Inventors: Shinichiro Fukui; Koichi Kuno, both of Minami-ashigara, Japan

[73] Assignee: Fuji Photo Film Co., Ltd., Kanagawa, Japan

[21] Appl. No.: 649,758

[22] Filed: May 15, 1996

[30] Foreign Application Priority Data

May 16, 1995 [JP] Japan ..... 7-140127

[51] Int. Cl.[6] ..... G03C 1/485

[52] U.S. Cl. ..... 430/596; 430/510; 430/512; 430/517; 430/523; 430/603; 430/604; 430/611

[58] Field of Search ..... 430/596, 603, 430/512, 611, 517, 510, 523, 604

[56] References Cited

U.S. PATENT DOCUMENTS

| | | | |
|---|---|---|---|
| 4,198,240 | 4/1980 | Mikawa | 430/603 |
| 4,284,717 | 8/1981 | Toya et al. | 430/596 |
| 5,298,381 | 3/1994 | Inoue et al. | 430/517 |

*Primary Examiner*—Thorl Chea
*Attorney, Agent, or Firm*—Sughrue, Mion, Zinn, Macpeak & Seas, PLLC

[57] ABSTRACT

A silver halide photographic material comprising a support having at least one pre-fogged direct positive emulsion layer provided on at least one side of the support, wherein silver halide grain formation of the emulsion is carried out in the presence of a silver halide solvent, the emulsion contains at least one of an Rh salt, an Ru salt or a polybromoiridium salt, and at least one compound selected from the group consisting of compounds represented by the following formula (I), (II) and (III) is added to the emulsion while the silver halide photographic material is prepared:

$$R—SO_2S—M \quad (I)$$

$$R—SO_2S—R^1 \quad (II)$$

$$R—SO_2S—L_m—SSO_2—R^2 \quad (III)$$

wherein R, $R^1$ and $R^2$ are the same or different, and each represents an aliphatic group, an aromatic group or a heterocyclic group; M represents a cation; L represents a divalent linking group; and m represents 0 or 1.

4 Claims, No Drawings

SILVER HALIDE PHOTOGRAPHIC MATERIAL

FIELD OF THE INVENTION

The present invention relates to a pre-fogged direct positive silver halide photographic material which is handlable in a bright room. In particular, the present invention relates to a direct positive silver halide photographic material which is excellent in storage stability and has improved photographic properties.

BACKGROUND OF THE INVENTION

Pre-fogged direct positive silver halide photographic materials conventionally used in the field of graphic arts are required to have high contrast toe gradation and low minimum density (Dmin). In particular, in "dot-to-dot" (contact work) in a printing process, if toe gradation is soft and Dmin is high and a dot image is contacted in a ratio of 1/1, the density of clear area of the dots (practical Dmin) becomes high. As a result, a good dot image cannot be obtained. Furthermore, pre-fogged direct positive silver halide photographic materials are generally fogged using a reducing agent so as to form a reduced Ag nucleus on the surface in such a degree that photobleach is possible after grain formation. However, since the formed Ag nucleus is unstable, sensitivity and gradation of the photographic material fluctuate greatly during storage. These fluctuations have been a drawback of pre-fogged direct positive silver halide photographic materials.

Moreover, practical Dmin has not been improved by only using a silver halide solvent during emulsion grain formation. Therefore, the commercial value of a pre-fogged direct positive silver halide emulsion could not been raised.

SUMMARY OF THE INVENTION

An object of the present invention is to provide a direct positive silver halide photographic material which is excellent in storage stability and shows low practical Dmin.

This and other objects of the present invention can be attained by a silver halide photographic material comprising a support having at least one pre-fogged direct positive emulsion layer on at least one side of the support, wherein silver halide grain formation of the emulsion is carried out in the presence of a silver halide solvent, the emulsion contains at least one of an Rh salt, an Ru salt and a polybromoiridium salt, and at least one compound selected from the group consisting of compounds represented by the following formulae (I), (II) and (III) is added to the emulsion while the silver halide photographic material is prepared:

$$R—SO_2S—M \quad (I)$$

$$R—SO_2S—R^1 \quad (II)$$

$$R—SO_2S—L_m—SSO_2—R^2 \quad (III)$$

wherein R, $R^1$ and $R^2$ are the same or different, and each represents an aliphatic group, an aromatic group or a heterocyclic group; M represents a cation; L represents a divalent linking group; and m represents 0 or 1.

DETAILED DESCRIPTION OF THE INVENTION

The compound represented by formula (I), (II) or (III) is explained in greater detail.

Preferable examples of the aliphatic group represented by R, $R^1$ or $R^2$ include an alkyl group having from 1 to 22 carbon atoms, an alkenyl group having from 2 to 22 carbon atoms, and an alkynyl group having from 2 to 22 carbon atoms, which each may be substituted with a substituent(s).

Examples of the alkyl group include methyl, ethyl, propyl, butyl, pentyl, hexyl, octyl, 2-ethylhexyl, decyl, dodecyl, hexadecyl, octadecyl, cyclohexyl, isopropyl, and t-butyl groups.

Examples of the alkenyl group include allyl and butenyl groups.

Examples of the alkynyl group include propargyl and butynyl groups.

The aromatic group represented by R, $R^1$ or $R^2$ is preferably an aryl group having from 6 to 20 carbon atoms, such as phenyl and naphthyl groups, which may be substituted with a substituent(s).

The heterocyclic group represented by R, $R^1$ or $R^2$ is preferably a 3- to 15-membered heterocyclic group having at least one element selected from nitrogen, oxygen, sulfur, selenium and tellurium. The heterocyclic group may be substituted with a substituent(s). Examples thereof include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, and thiadiazole.

Examples of the substituents for substituted aliphatic, aromatic and heterocyclic groups represented by R, $R^1$ or $R^2$ include an alkyl group (e.g., methyl, ethyl, hexyl), an alkoxy group (e.g., methoxy, ethoxy, octyl), an aryl group (e.g., phenyl, naphthyl, tolyl), a hydroxyl group, a halogen atom (e.g., fluorine, chlorine, bromine, iodine), an aryloxy group (e.g., phenoxy), an alkylthio group (e.g., methylthio, butylthio), an arylthio group (e.g., phenylthio), an acyl group (e.g., acetyl, propionyl, butyryl, valeryl), a sulfonyl group (e.g., methylsulfonyl, phenylsulfonyl), an acylamino group (e.g., acetylamino, benzamino), a sulfonylamino group (e.g., methanesulfonylamino, benzosulfonylamino), an acyloxy group (e.g., acetoxy, benzoxy), a carboxyl group, a cyano group, a sulfo group and an amino group.

L is preferably a divalent aliphatic group or a divalent aromatic group. Examples of the divalent aliphatic group include $—(CH_2)_n—$ (n is from 1 to 12), $—CH_2—CH=CH—CH_2—$, $—CH_2CCCH_2—$ (between C and C is a triple bond), and $—CH_2—CH(CH_3)—C_2H_5—CH(CH_3)—CH_2$-xylylene. Examples of the divalent aromatic group include phenylene and naphthylene groups.

These substituents may further be substituted with substituents described above with regard to R, $R^1$ and $R^2$.

M is preferably a metal ion or an organic cation. Examples of the metal ion include a lithium ion, a sodium ion, and a potassium ion. Examples of the organic cation include an ammonium ion (e.g., ammonium, tetramethylammonium, tetrabutylammonium), a phosphonium ion (e.g., tetraphenylphosphonium), and a guanidine group.

Specific examples of the compounds represented by formula (I), (II) or (III) are shown below but the present invention is not limited thereto.

$$CH_3SO_2SNa \quad (1\text{-}1)$$

$$C_2H_5SO_2SNa \quad (1\text{-}2)$$

$$C_3H_7SO_2SK \quad (1\text{-}3)$$

$$C_4H_9SO_2SLi \quad (1\text{-}4)$$

-continued
$C_6H_{13}SO_2SNa$ (1-5)
$C_8H_{17}SO_2SNa$ (1-6)
$CH_2(CH_2)_2CH(C_2H_5)CH_2SO_2S.NH_4$ (1-7)
$C_{10}H_{21}SO_2Na$ (1-8)
$C_{12}H_{25}SO_2Na$ (1-9)
$C_{16}H_{33}SO_2Na$ (1-10)
$(CH_3)_2CH-SO_2SK$ (1-11)
$t\text{-}C_4H_9SO_2SNa$ (1-12)
$CH_3OCH_2CH_2SO_2SNa$ (1-13)
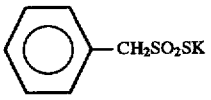
(1-14)
$CH_2=CHCH_2SO_2SNa$ (1-15)
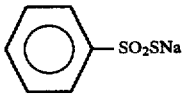
(1-16)
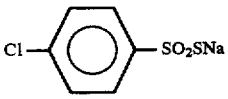
(1-17)
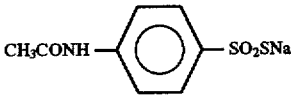
(1-18)
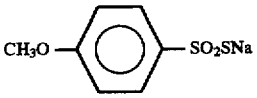
(1-19)
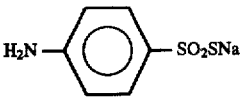
(1-20)
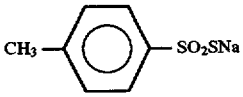
(1-21)
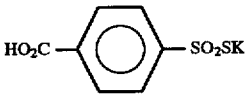
(1-22)
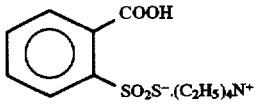
(1-23)
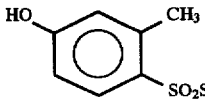
(1-24)
-continued
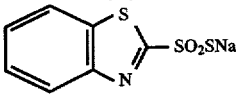
(1-25)
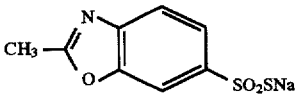
(1-26)
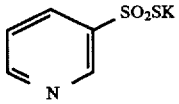
(1-27)
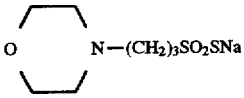
(1-28)
$C_2H_5SO_2S-CH_3$ (2-1)
$C_8H_{17}SO_2SCH_2CH_3$ (2-2)
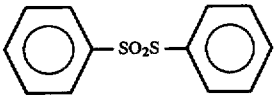
(2-3)
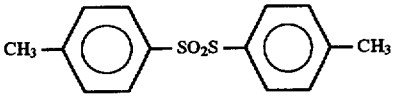
(2-4)
$C_2H_5SO_2SCH_2CH_2CN$ (2-5)
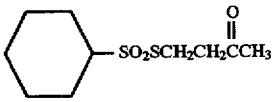
(2-6)
$C_4H_9SO_2SCH(CH_3)CH_2CN$ (2-7)
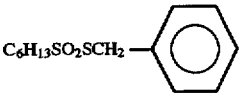
(2-8)
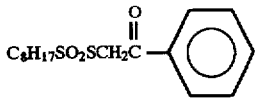
(2-9)
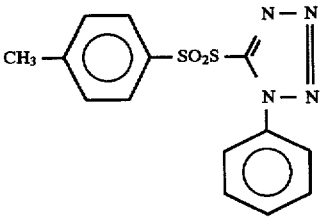
(2-10)
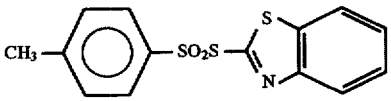
(2-11)
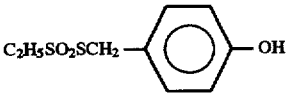
(2-12)

-continued (2-13)

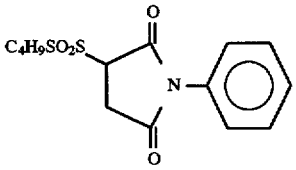

(2-14)

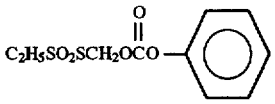

(2-15)

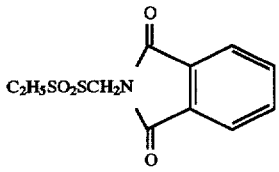

(2-16)

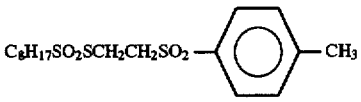

(2-17)

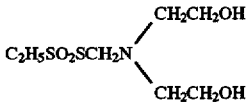

(2-18)

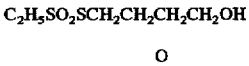

(2-19)

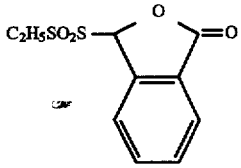

(2-20)

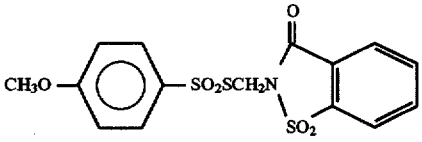

(3-1)

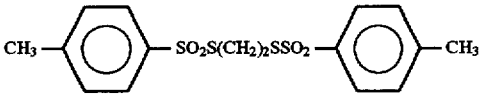

(3-2)

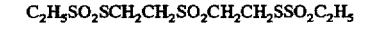

(3-3)

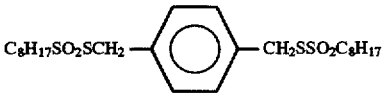

(3-4)

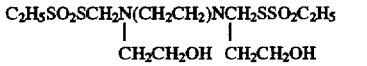

(3-5)

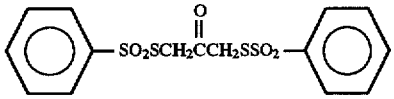

(3-6)

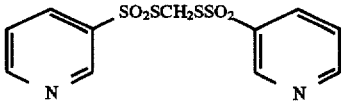

(3-7)

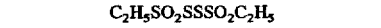

-continued (3-8)

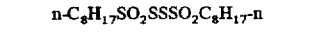

(3-9)

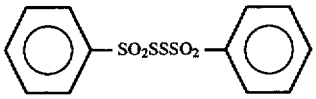

The compounds represented by formula (I), (II) or (III) can be easily synthesized according to the method disclosed in JP-A-54-1019 (the term "JP-A" as used herein means an "unexamined published Japanese patent application") and British Patent 972,211.

The compounds represented by formula (I), (II) or (III) are preferably used in an amount of from $10^{-8}$ to $10^{-3}$ mol, more preferably from $10^{-8}$ to $10^{-4}$ mol, and particularly preferably from $10^{-7}$ to $10^{-5}$ mol, per mol of Ag.

The compounds represented by formula (I), (II) or (III) can be added to an emulsion while the photographic material is prepared according to methods usually used for adding additives to a photographic emulsion. For example, water-soluble compounds can be added as an aqueous solution having an appropriate concentration. On the other hand, water-insoluble or hardly soluble compounds can be added as a solution dissolved in an appropriate organic solvent which is miscible with water and does not adversely affect photographic properties. The organic solvent may be selected from, e.g., alcohols, glycols, ketones, esters or amides.

The compounds represented by formula (I), (II) or (III) can be added at any stage of manufacturing, e.g., before or during grain formation of silver halide emulsion, or before or after chemical sensitization. The compounds are preferably added before or during fogging process. The compounds are more preferably added before or during grain growth.

The compounds may be previously added to a reaction vessel but are preferably added at a proper stage during grain formation. Furthermore, the compounds represented by formulae (I), (II) or (III) have been previously added to an aqueous solution of water-soluble silver salt or an aqueous solution of water-soluble alkali halide and grains can be formed using these aqueous solutions. In addition, the solution of the compounds may be added batchwise or may be added continuously over a long period of time with the degree of grain formation.

Most preferred compounds for use in the present invention are those represented by formula (I).

Examples of the silver halide solvent for use in the present invention include (a) organic thioethers disclosed in U.S. Pat. Nos. 3,271,157, 3,531,289 and 3,574,628, JP-A-54-1019 and JP-A-54-158917, (b) thiourea derivatives disclosed in JP-A-53-82408, JP-A-55-77737 and JP-A-55-2982, (c) silver halide solvents having a thiocarbonyl group between an oxygen or sulfur atom and a nitrogen atom disclosed in JP-A-53-144319, (d) imidazoles disclosed in JP-A-54-100717, (e) sulfites, and (f) thiocyanates. Specific examples thereof are shown below.

(4-1)

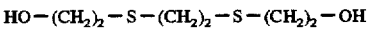

(4-2)

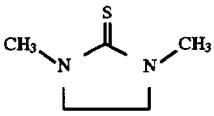

-continued

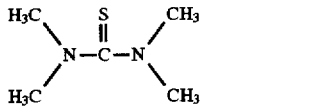
(4-3)

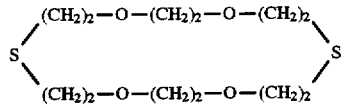
(4-4)

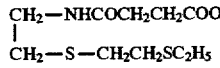
(4-5)

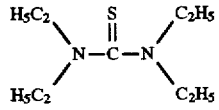
(4-6)

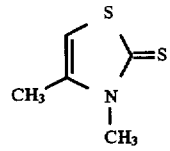
(4-7)

The addition amount of the above silver halide solvent for use in the emulsion of the present invention is, for example, in the case of thiocyanate, from 10 to 1,000 mg, preferably from 50 to 200 mg, per mol of silver halide.

The silver halide for use in the present invention may be any composition but is preferably silver bromide or silver chlorobromide. When silver chlorobromide is used, the content of silver chloride is preferably 50 mol % or more, more preferably 80 mol % or more.

The grain size is from 0.10 μm to 1.0 μm, preferably from 0.15 μm to 0.40 μm.

The silver halide grains in the photographic emulsion preferably have a regular crystal form such as a cubic and an octahedral form.

The grain size distribution is preferably narrow. In particular, monodisperse emulsions in which 90% of the entire grain number, preferably 95%, is present within ±40% of the average grain size are preferred.

The direct positive emulsion for use in the present invention contains at least one of rhodium salt compounds, ruthenium salt compounds and polybromoiridium salt compounds (including complexes thereof) in silver halide grains in an amount of from $10^{-6}$ to $10^{-4}$ mol, preferably from $10^{-5}$ to $10^{-4}$ mol, per mol of silver halide.

The rhodium and ruthenium complexes for use in the present invention are preferably complexes having six ligands represented by the following formula:

$$[M'(NY)_n—L'_{(6-n)}]^{m'}$$

wherein M' represents rhodium or ruthenium; L' represents a crosslinking ligand; Y represents oxygen or sulfur; m' represents 0, −1, −2or −3; and n represents 0, 1 or 2.

Preferred examples of L' include a halide ligand (e.g., fluoride, chloride, bromide, iodide), a nitrosyl ligand, a thionitrosyl ligand, a cyanide ligand, a cyanate ligand, a thiocyanate ligand, a selenocyanate ligand, a tellurocyanate ligand, an azido ligand and an aquo ligand. When an aquo ligand is present, it is preferred for an aquo ligand to occupy one or two ligands. Furthermore, it is particularly preferred to add a polybromoiridium salt, and it is more preferred that polybromoiridium salt is added in the form of K salt or Na salt.

The above metal complexes can be added to silver halide during preparation of silver halide grains.

They may be added so as to be distributed uniformly entirely in silver halide grains but they are preferably added to be present in the interior core of silver halide grains.

Specifically, 90% of the rhodium, ruthenium and polybromoiridium salts are added to the silver halide emulsion in a reaction vessel of grain formation before 5% of the total silver amount used during the grain formation are added. More preferably, all amounts of rhodium, ruthenium and polybromoiridium salts to be added are added to a reaction vessel of grain formation before 4% of the total silver amount used during grain formation are added.

Fogging process of the direct positive silver halide emulsion of the present invention can be conducted by known methods, such as light or chemical processing. Such fogging can be attained by various methods, for example, by continuing chemical sensitization until fog is generated, and particularly good results can be obtained by the method disclosed, for example, in *Science et Industrie, Photographique*, 28, Jan. (1957), pages 57 to 65. Silver halide grains are fogged by strong light, a reduction fogging agent such as thiourea dioxide or stannous chloride, or a gold or noble metal compound. A combination of a reducing agent with a gold compound or a metal electrically more positive than silver, e.g., a rhodium, platinum or iridium compound, can also be used for fogging of silver halide grains.

A reduction fogging agent is used for fogging of silver halide grains in an amount of from $1.0\times10^{-6}$ to $1.0\times10^{-1}$ mol per mol of silver halide. If the concentration of a reducing agent is too large, photographic speed is extremely impaired. Examples of the reduction fogging agents which can be used in the present invention include hydrazines, phosphonium salts, e.g., tetra(hydroxymethyl)phosphonium chloride, thiourea dioxide (U.S. Pat. Nos. 3,062,654 and 2,983,609); stannous salts e.g., stannous chloride (U.S. Pat. No. 2,487,850); polyamines, e.g., diethylenetriamine (U.S. Pat. No. 2,519,698); also polyamines, e.g., spermine (U.S. Pat. No. 2,521,925); and bis(β-aminoethyl)sulfide and water-soluble salts thereof (U.S. Pat. No. 2,521,926).

In the execution of the present invention, the silver halide grains can be fogged before coating or can be fogged after coating. The reaction conditions when fogging the silver halide grains can be varied widely but, in general, the pH is about 5 to 7, the pAg is about 7 to 9, and the temperature is about 40° to 100° C., most commonly about 50° to 70° C.

In the present invention, it is preferred to use a water-soluble dye or a dye which is capable of solid dispersion (hereinafter referred to as a "solid dispersion dye") having main absorption in the visible wavelength region of the inherent light-sensitive wavelength region of the silver halide emulsion to be used. Above all, a dye having Amax in the range of from 350 nm to 600 nm is preferred. Chemical structures of dyes are not particularly limited and an oxonol dye, a hemioxonol dye, a merocyanine dye, a cyanine dye and an azo dye can be used.

Specific examples of the water-soluble dyes include pyrazolone dyes disclosed in JP-B-58-12576 (the term "JP-B" as used herein means an "examined Japanese patent publication"), pyrazolone oxonol dyes disclosed in U.S. Pat. No. 2,274,782, diarylazo dyes disclosed in U.S. Pat. No. 2,956,879, styryl dyes and butadienyl dyes disclosed in U.S. Pat. No. 3,423,207 and 3,384,487, merocyanine dyes disclosed in U.S. Pat. No. 2,527,583, merocyanine dyes and oxonol dyes disclosed in U.S. Pat. Nos. 3,486,897, 3,652,284 and 3,718,472, enaminohemioxonol dyes disclosed in U.S. Pat. No. 3,976,661, and dyes disclosed in British Patents 584,609 and 1,177,429, JP-A-48-85130, JP-A-49-99620, JP-A-49-114420, U.S. Pat. Nos. 2,533,472, 3,148,187, 3,177,078, 3,247,127, 3,540,887, 3,575,704 and 3,653,905.

The solid dispersion dyes in a microcrystalline state are added to an upper layer of the emulsion layer for the purpose of improving practical Dmin. The coating weight of these dyes is preferably from 10 mg to 500 mg, particularly preferably from 30 mg to 300 mg, per $m^2$.

In the present invention, as the solid dispersion dyes in a microcrystalline state, the dyes disclosed in Tables I to X of WO 88/04794, the dyes represented by the following formulae (IV), (V), (VI), (VII), (VIII), (IX) and (X), and others can be used.

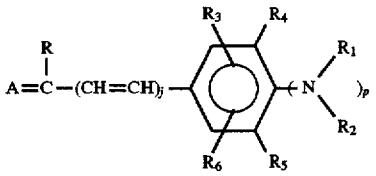

(IV)

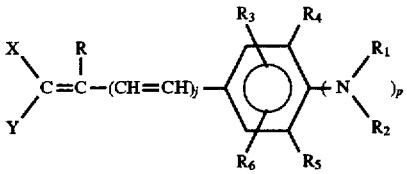

(V)

$A=L_1-(L_2=L_3)_k-A'$ (VI)

$A=(L_1-L_2)_{2-q}=B$ (VII)

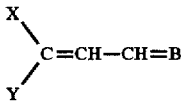

(VIII)

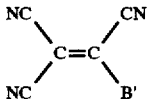

(IX)

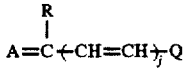

(X)

wherein A and A' are the same or different, and each represents an acidic nucleus; B represents a basic nucleus; X and Y are the same or different, and each represents an electron attractive group; R represents a hydrogen atom or an alkyl group; $R_1$ and $R_2$ are the same or different, and each represents an alkyl group, an aryl group, an acyl group or a sulfonyl group, and $R_1$ and $R_2$ may be linked to form a 5- or 6-membered ring; $R_3$ and $R_6$ are the same or different, and each represents a hydrogen atom, a hydroxyl group, a carboxyl group, an alkyl group, an alkoxy group or a halogen atom; $R_4$ and $R_5$ are the same or different, and each represents a hydrogen atom or a nonmetal atomic group necessary for forming a 5- or 6-membered ring by linking to $R_1$ and $R_2$, respectively; $L_1$, $L_2$ and $L_3$ are the same or different, and each represents a methine group; j represents 0 or 1; k and q each represents 0, 1 or 2; p represents 0 or 1, and when p is 0, $R_3$ represents a hydroxyl group or a carboxyl group, and $R_4$ and $R_5$ represent hydrogen atoms; B' represents a heterocyclic group having a carboxyl group, a sulfamoyl group or a sulfonamido group; and Q represents a heterocyclic group, provided that the compounds represented by formulae (IV) to (X) have at least one dissociative group having pKa of from 4 to 11 in a mixed solution of water and ethanol at a volume ratio of 1/1 per molecule.

The solid dispersion dyes are disclosed in WO 88/04794, EP-A-274723, EP-A-276566, EP-A-299435, JP-A-52-92716, JP-A-55-155350, JP-A-55-155351, JP-A-61-205934, JP-A-48-68623, U.S. Pat. No. 2,527,583, 3,586,897, 3,746,539, 3,933,798, 4,130,429, 4,040,841, JP-A-3-7931, JP-A-2-282244, JP-A-3-167546, JP-A-5-113623, and Japanese Patent Application No. 6-311265. The dispersing methods are also disclosed in the above references but, in addition, examples thereof include a method in which a dye is mechanically dispersed in water with an appropriate dispersant using a ball mill; a sand mill or a colloid mill, a method in which after a dye in a dissociative state is coated, acidic gelatin is coated thereon to obtain dispersion solid at the time of coating; a method in which the pH is adjusted to dissolve a dye to make an alkaline aqueous solution, then microcrystallized by lowering the pH in the presence of a protective colloid such as gelatin; or a method in which after dissolving a dye in an appropriate solvent, a poor solvent of the dye is added to obtain dispersion solid by precipitation.

The dyes having absorption maximum at 300 to 500 nm are preferably used in the present invention. Specific examples of dyes are shown below, but the present invention is not limited to these dyes.

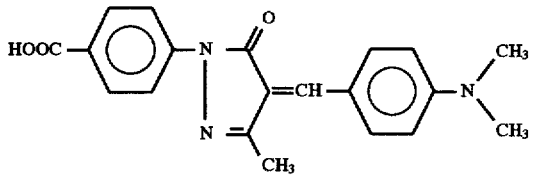

IV-1

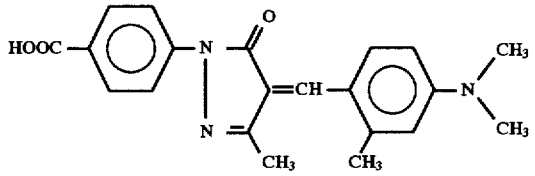

IV-2

-continued
IV-3
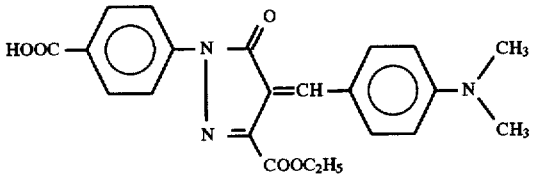
IV-4
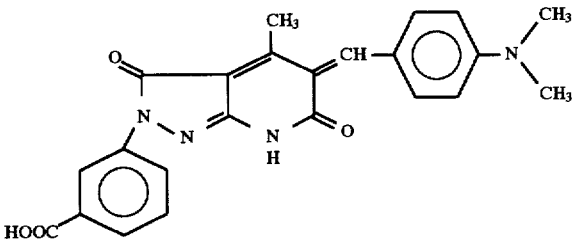
V-1
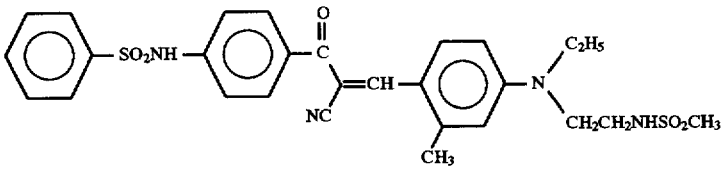
VI-1
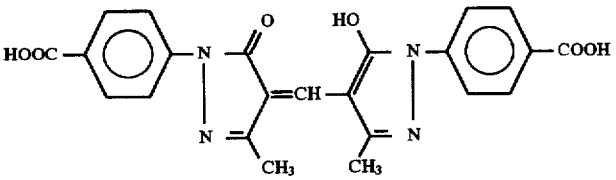
VI-2
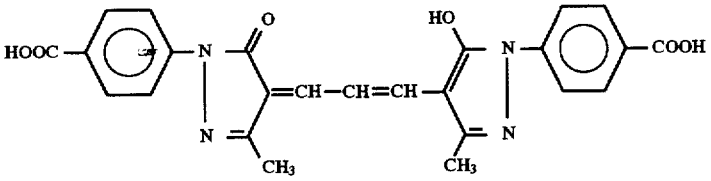
VI-3
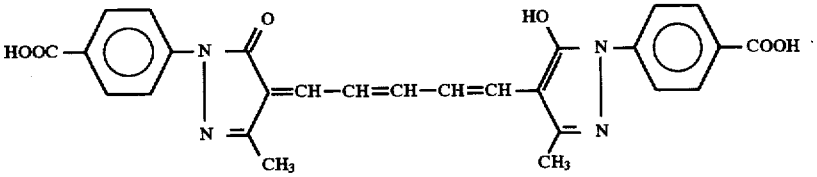
VI-4
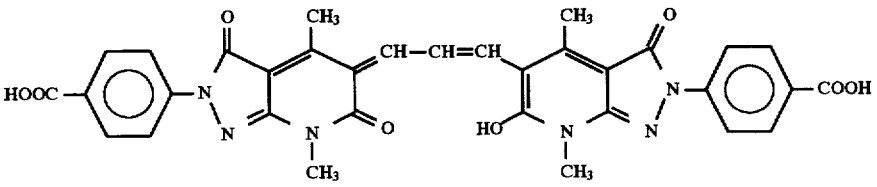
VI-5
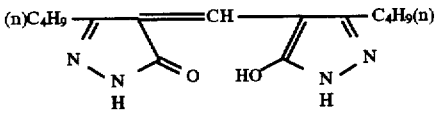
VII-1
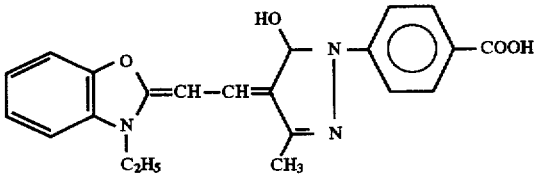

-continued

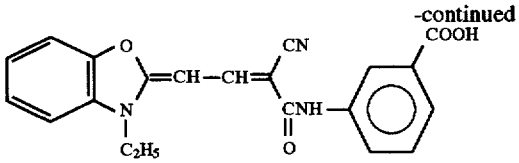

VIII-1

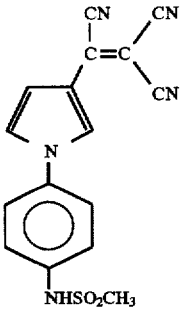

IX-1

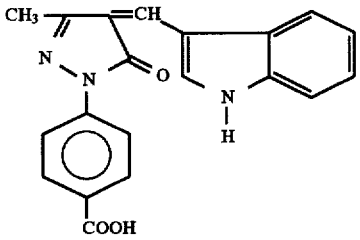

X-1

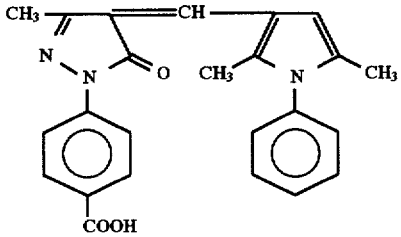

X-2

Furthermore, the direct positive silver halide photographic material of the present invention can contain a solid dispersion dye and/or a water-soluble dye in layers other than the above-described layer within the range not impairing the effect of the present invention for improving safelight safety and the like. The preferred addition amount is, when added to an emulsion layer, within such a range as the lowering of the sensitivity due to the addition not to exceed 0.2 in terms of logE, e.g., from 5 to 100 mg/m$^2$.

Preferably, the pre-fogged direct positive emulsion layer is provided on the support, and a layer containing the solid dispersion dye is further provided on the pre-fogged direct positive emulsion layer.

The direct positive silver halide photographic material of the present invention can contain commonly used other various photographic additives. As a stabilizer, for example, triazolels, azaindenes, quaternary benzothiazolium compounds, mercapto compounds, or water-soluble inorganic salts, such as cadmium, cobalt, nickel, manganese, gold, thallium, and zinc, may be contained. As a hardening agent, for example, aldehydes such as formalin, glyoxal, and mucochloric acid, S-triazines, epoxies, aziridines, and vinylsulfonic acid, and as a coating aid, for example, saponin, sodium polyalkylene sulfonates, lauryl or oleyl monoether of polyethylene glycol, amylated alkyltaurines, and fluorine-containing compounds can be contained. Furthermore, color couplers can be included. In addition, if required, a brightening agent, an ultraviolet absorber, a biocide, a matting agent and an antistatic agent can be added.

The photographic emulsion layers or other hydrophilic colloid layers of the photographic material according to the present invention may contain various surfactants for various purposes such as coating assistance, static charge prevention, improving sliding property, emulsifying dispersion, adhesion prevention, and improving photographic properties (e.g., development acceleration, enhancement of high contrast, sensitization).

Examples thereof include nonionic surfactants such as saponin (steroid series), alkylene oxide derivatives (e.g., polyethylene glycol, polyethylene glycol/polypropyrene glycol condensation product, polyethylene glycol alkyl ethers, polyethylene glycol alkyl aryl ethers, polyethylene glycol esters, polyethylene glycol sorbitan esters, polyalkylene glycol alkylamines or amides, polyethylene oxide adducts of silicon), glycidol derivatives (e.g., alkenylsuccinic acid polyglyceride, alkylphenol polyglyceride), fatty acid esters of polyhydric alcohol, and alkyl esters of sucrose; anionic surfactants having an acidic group (e.g., a carboxyl group, a sulfo group, a phospho group, a sulfuric acid ester group, a phosphoric acid ester group), such as alkylcarboxylates, alkylsulfonates, alkylbezenesulfonates, alkylnaphtalenesulfonates, alkylsulfates, alkylphosphates, N-acyl-N-alkyltaurines, sulfosuccinates, sulfoalkyl polyoxyethylenealkylphenyl ethers, and polyoxyethylene alkylphosphates; amphoteric surfactants such as amino acids, aminoalkylsulfonic acids, aminoalkylsulfates, aminoalkylphosphates, alkylbetains, and amine oxides; and cationic surfactants such as alkylamine salts, aliphatic or aromatic quaternary ammonium salts, heterocyclic quaternary ammonium salts (e.g., pyridinium and imidazolium), and aliphatic or heterocyclic phosphonium or sulfonium salts.

The surfactants particularly preferably used in the present invention are polyalkylene oxides having a molecular weight of 600 or more disclosed in JP-B-58-9412.

The polyalkylene oxide compound for use in the present invention includes alkylene oxide having from 2 to 4 carbon atoms, for example, ethylene oxide, propylene-1,2-oxide, and butylene-1,2-oxide, preferably a condensation product of polyalkylene oxide comprising at least 10 units of ethylene oxide with a compound having at least one active hydrogen atom such as water, aliphatic alcohol, aromatic alcohol, fatty acid, organic amine, or a hexitol derivative, or a block copolymer of two or more of polyalkylene oxides. That is, specific examples of the polyalkylene oxide compounds which can be used in the present invention include:

polyalkylene glycols, polyalkylene glycol alkyl ethers, polyalkylene glycol aryl ethers, polyalkylene glycol (alkylaryl) ethers, polyalkylene glycol esters, polyalkylene glycol fatty acid amides, polyalkylene glycol amines, polyalkylene glycol block copolymers, and polyalkylene glycol graft polymers. It is necessary that the molecular weight is 600 or more.

Polyalkylene oxides are not limited to one in one molecule and two or more may be contained. In such a case, each polyalkylene oxide may comprise less than 10 alkylene oxide units, but the total number of the alkylene oxide units in the molecule must be at least 10. When 2 or more polyalkylene oxides exist in the molecule, each of them may comprise different alkylene oxide units, for example, ethylene oxide and propylene oxide. The polyalkylene oxide compounds for use in the present invention preferably contain from 14 to 100 alkylene oxide units.

When these polyalkylene oxide compounds are added to a silver halide emulsion, they can be added as an aqueous solution having a proper concentration or dissolved in a low boiling point organic solvent miscible with water and added to an emulsion at appropriate time before coating, preferably after chemical sensitization. In place of adding to an emulsion, they may be added to light-insensitive hydrophilic colloid layers, e.g., an interlayer, a protective layer, a filter layer.

The photographic material of the present invention can contain a matting agent such as silica, magnesium oxide, or polymethyl methacrylate in photographic emulsion layers or other hydrophilic colloid layers for preventing adhesion.

The photographic emulsion of the present invention can contain water-insoluble or hardly soluble synthetic polymer dispersion for improving dimensional stability. For example, alkyl (meth)acrylate, alkoxyalkyl (meth)acrylate, (meth) acrylamide, vinyl ester (e.g., vinyl acetate), and acrylonitrile can be used alone or in combination.

The emulsion for use in the present invention uses primarily gelatin as a protective colloid, in particular, inert gelatin is preferably used. In place of gelatin, photographically inert gelatin derivatives (e.g., phthalated gelatin), water-soluble synthetic polymers, e.g., polyvinyl acrylate, polyvinyl alcohol, polyvinyl pyrrolidone can be used.

The silver halide emulsion of the present invention is coated on an arbitrary proper photographic support, for example, glass, a film base, e.g., cellulose acetate, cellulose acetate butyrate, polyester (e.g., poly(ethylene terephthalate)).

In particular, it is preferred that a polyester support is coated on a vinylidene chloride copolymer, and then a hydrophilic colloid layer is further coated thereon.

The vinylidene chloride copolymer herein is a copolymer containing from 50 to 99.5 wt %, preferably from 70 to 99 wt %, of vinylidene chloride. Examples thereof include copolymers comprising a vinylidene chloride/acrylate/vinyl monomer having an alcohol at side chain disclosed in JP-A-51-135526, copolymers comprising vinylidene chloride/alkyl acrylate/acrylic acid disclosed in U.S. Pat. No. 2,852,378, copolymers comprising vinylidene chloride/acrylonitrile/itaconic acid disclosed in U.S. Pat. No. 2,698,235, copolymers comprising vinylidene chloride/alkyl acrylate/itaconic acid disclosed in U.S. Pat. No. 3,788,856, and core/shell type vinylidene chloride copolymers disclosed in JP-A-2-24648, JP-A-2-24649 and JP-A-3-141346.

Vinylidene chloride copolymers can be coated on a polyester support as a solution obtained by dissolving these polymers in an appropriate organic solvent or water dispersion solution using generally known coating methods, for example, a dip coating method, an air knife coating method, a curtain coating method, a roller coating method, a wire bar coating method, a gravure coating method, or an extrusion coating method using a hopper as disclosed in U.S. Pat. No. 2,681,294. Alternatively, an extrusion coating method in which a melted polymer made filmy is flowed on a traveling polyester support and adhered with pressure simultaneously with cooling can be used.

Various treatments can be conducted to further enhance the adhesive strength between the polyester support and the above polymer layer, such as chemical treatment, mechanical treatment, corona discharge treatment, flame treatment, ultraviolet treatment, high frequency treatment, glow discharge treatment, activated plasma treatment, high pressure water vapor treatment, desorption treatment, laser treatment, mixed acid treatment, or ozone oxidation treatment.

Furthermore, the adhesion strength between the polymer layer and the support can be heightened by a method of adding the swelling agents of polyester to the above polymer layer as disclosed in U.S. Pat. Nos. 3,245,937, 3,143,421, 3,501,301 and 3,271,178, such as phenol, resorcin, o-cesol, m-cresol, trichloroacetic acid, dichloroacetic acid, monochloroacetic acid, chloral hydrate and benzyl alcohol, or a method of adding the triazine-based crosslinking agents disclosed in JP-A-3-10945 and JP-A-3-141347.

The thickness of the polymer layer comprising the vinylidene chloride copolymer of the present invention is 0.3 μm or more, preferably from 0.5 to 3.0 μm.

Polyester comprises aromatic dibasic acid and glycol as major components. Examples of the dibasic acid include terephthalic acid, isophthalic acid, p-β-oxyethoxybenzoic acid, diphenylsulfone dicarboxylic acid, diphenoxyethanedicarboxylic acid, adipic acid, sebacic acid, azelaic acid, 5-sodium sulfoisophthalic acid, diphenylenedicarboxylic acid, and 2,6-naphthalenedicarboxylic acid. Examples of the glycol include ethylene glycol, propylene glycol, butanediol, neopentylene glycol, 1,4-cyclohexanediol, 1,4-cyclohexanedimethanol, 1,4-bisoxyethoxybenzene, bisphenol A, diethylene glycol, and polyethylene glycol.

Of these polyesters comprising these components, polyethylene terephthalate is most preferred in view of easy availability.

No particular limitation is imposed on the thickness of the polyester and is about 12 μm to 500 μm, preferably about 40

μm to 200 μm, considering handlability and wide applicability. In particular, those biaxially stretched and crystallized are favorable in view of stability and strength.

For the enhancement of the adhesion of the above polymer layer and the emulsion layer, an undercoat layer having the adhesive property to each of them can be provided. For further improving the adhesive property, the surface of the polymer layer may be subjected to a preliminary treatment conventionally conducted, such as corona discharge, ultraviolet irradiation, or flame treatment.

Specific examples of the compounds include the following. (The numerals in the parentheses indicate weight ratio.)

V-1 Copolymer of vinylidene chloride/methyl acrylate/hydroxyethyl acrylate (83/12/5)

V-2 Copolymer of vinylidene chloride/ethyl methacrylate/hydroxypropyl acrylate (82/10/8)

V-3 Copolymer of vinylidene chloride/hydroxydiethyl methacrylate (92/8)

V-4 Copolymer of vinylidene chloride/butyl acrylate/acrylic acid (94/4/2)

V-5 Copolymer of vinylidene chloride/butyl acrylate/itaconic acid (75/20/5)

V-6 Copolymer of vinylidene chloride/methyl acrylate/itaconic acid (90/8/2)

V-7 Copolymer of vinylidene chloride/itaconic acid monoethyl ester (96/4)

V-8 Copolymer of vinylidene chloride/acrylonitrile/acrylic acid (95/3.5/1.5)

V-9 Copolymer of vinylidene chloride/methyl acrylate/acrylic acid (90/5/5)

V-10 Copolymer of vinylidene chloride/ethyl acrylate/acrylic acid (92/5/3)

V-11 Copolymer of vinylidene chloride/methyl acrylate/3-chloro-2-hydroxypropyl acrylate (84/9/7)

V-12 Copolymer of vinylidene chloride/methyl acrylate/N-ethanolacrylamide (85/10/5)

V-13 Copolymer of vinylidene chloride/methyl methacrylate/methyl acrylate/acrylonitrile/acrylic acid (90.5/4/4/1/0.5)

V-14 (core/shell type latex water dispersion, core part: 80 wt %, shell part: 20 wt %)

core part: vinylidene chloride/methyl methacrylate/methyl acrylate (90/5/5)

shell part: vinylidene chloride/acrylonitrile/acrylic acid (92.5/5/2.5)

The developing solution for use in the present invention is described below.

Examples of hydroquinone based developing agents for use in the present invention include hydroquinone, chlorohydroquinone, bromohydroquinone, isopropylhydroquinone, methylhydroquinone, 2,3-dibromohydroquinone and 2,5-dimethylhydroquinone. Among these, hydroquinone is particularly preferred. The concentration of the hydroquinone derivative in a developing solution is from 0.2 to 0.75 mol/liter, preferably from 0.2 to 0.5 mol/liter, and particularly preferably from 0.2 to 0.4 mol/liter.

Examples of 1-phenyl-3-pyrazolidone derivative developing agents for use in the present invention include 1-phenyl-3-pyrazolidone,1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1l-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone. The concentration of the 1-phenyl-3-pyrazolidone derivative is from 0.001 to 0.06 mol/liter, preferably from 0.001 to 0.02 mol/liter, and particularly preferably from 0.003 to 0.01 mol/liter.

Furthermore, it is preferred for the developing solution of the present invention to contain the compounds represented by the following formula (XI) and/or (XII):

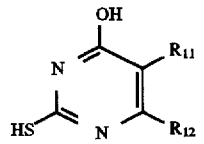

(XI)

wherein $R_{11}$ and $R_{12}$ are the same or different, and each represents a hydrogen atom, an alkyl group, an aryl group, an aralkyl group, a hydroxyl group, a mercapto group, a carboxyl group, a sulfo group, a phosphono group, an amino group, a nitro group, a cyano group, a halogen atom, an alkoxycarbonyl group, an aryloxycarbonyl group, a carbamoyl group, a sulfamoyl group or an alkoxy group, or $R_{11}$ and $R_{12}$ may be linked to form a ring structure:

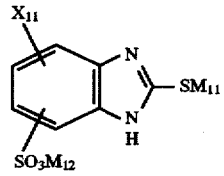

(XII)

wherein $X_{11}$, represents a hydrogen atom or a sulfonic acid group; $M_{11}$ represents a hydrogen atom or an alkali metal atom; $M_{12}$ represents a hydrogen atom, an alkali metal atom or an ammonium group.

The compound represented by formula (XI) is described in detail below.

Preferably, either of $R_{11}$ and $R_{12}$ represents an alkyl group having from 1 to 10 carbon atoms which may be substituted, an aryl group having from 6 to 12 carbon atoms which may be substituted, an aralkyl group having from 7 to 12 carbon atoms which may be substituted, a nitro group, a cyano group, or a halogen atom. The sum total of the carbon atoms of $R_{11}$, and $R_{12}$ is preferably from 2 to 20. Preferably, $R_{11}$ and $R_{12}$ may be linked to form a saturated 5- or 6-membered ring.

More preferably, $R_{11}$ represents a hydrogen atom, or an alkyl group substituted with an amino group or a heterocyclic group, and $R_{12}$ represents an alkyl group having from 1 to 10 carbon atoms which may be substituted, or an aryl group having from 6 to 12 carbon atoms which may be substituted, or $R_{11}$ and $R_{12}$ may be linked to form a saturated 5- or 6-membered ring. Specifically, $R_{11}$ represents a dimethylaminomethyl group, a morpholinomethyl group, an N-methylpiperazinylmethyl group, or a pyrrolidinylmethyl group, and $R_{12}$ represents a methyl group, an ethyl group, a phenyl group, or a p-methoxyphenyl group.

As the specific examples of the compounds represented by formula (XI), Compounds I-1 to I-14 of JP-A-5-232641 can be cited but the present invention is not limited thereto.

The compound represented by formula (XI) is used in an amount of preferably from 0.01 to 100 mmol, more preferably from 0.1 to 10 mmol, per liter of the developing solution.

The compound represented by formula (XII), when $M_{11}$ represents a hydrogen atom, may be a tautomer thereof.

Preferred examples of the compounds represented by formula (XII) are shown below but the present invention is not limited thereto.

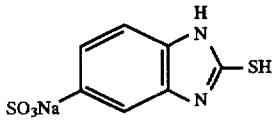
(XII-1)

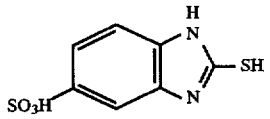
(XII-2)

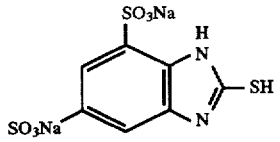
(XII-3)

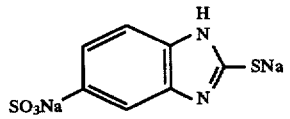
(XII-4)

The compound represented by formula (XII) is used in an amount of preferably from 0.01 to 100 mmol, more preferably from 0.1 to 10 mmol, per liter of the developing solution.

Furthermore, it is preferred to use a developing solution containing the compound represented by the following formula (XIII) in an amount of from 0.03 to 0.12 of the concentration ratio of the compound represented by formula (XIII) to the hydroquinone developing agent and having a pH of from 9.5 to 12.0.

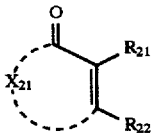
(XIII)

The compound represented by formula (XIII) is described in detail below.

In the formula, $R_{21}$ and $R_{22}$ are the same or different, and each represents a hydroxyl group, an amino group (including an amino group substituted with an alkyl group having from 1 to 10 carbon atoms, e.g., methyl, ethyl, n-butyl, hydroxyethyl), an acylamino group (e.g., acetylamino, benzoylamino), an alkylsulfonylamino group (e.g., methanesulfonylamino), an arylsulfonylamino group (e.g., benzenesulfonylamino, p-toluenesulfonylamino), an alkoxycarbonylamino group (e.g., methoxycarbonylamino), a mercapto group, or an alkylthio group (e.g., methylthio, ethylthio). Preferred examples of $R_{21}$ and $R_{22}$ include a hydroxyl group, an amino group, an alkylsulfonylamino group, or an arylsulfonylalmino group. $X_{21}$ comprises a carbon atom, an oxygen atom, or a nitrogen atom, and $X_{21}$ forms a 5- or 6-membered ring together with two vinyl carbon atoms substituted with $R_{21}$ and $R_{22}$ and a carbonyl carbon atom. Specific examples of $X_{21}$ include —O—, —C($R_{23}$)($R_{24}$)—, —C($R_{25}$)=, —C(=O)—, —N($R_{26}$)—, —N= in combination, wherein $R_{23}$, $R_{24}$, $R_{25}$ and $R2_6$ are the same or different, and each represents a hydrogen atom, an alkyl group having from 1 to 10 carbon atoms which may be substituted (substituents therefor include a hydroxyl group, a carboxyl group, and a sulfo group), an aryl group having from 6 to 15 carbon atoms which may be substituted (substituents therefor include an alkyl group, a halogen atom, a hydroxyl group, a carboxyl group, and a sulfo group), a hydroxyl group, or a carboxyl group. Furthermore, this 5- or 6-membered ring may be condensed with a saturated or unsaturated ring. Examples of the 5- or 6-membered ring include a dihydrofuranone ring, a dihydropyrroline ring, a pyranone ring, a cyclopentenone ring, a cyclohexenone ring, a pyrrolinone ring, a pyrazolinone ring, a pyridone ring, an azacyclohexenone ring, and a uracil ring, and preferred examples thereof include a dihydrofuranone ring, a cyclopentenone ring, a cyclohexenone ring, a pyrazolinone ring, an azacyclohexenone ring, and a uracil ring.

Specific examples of the compounds represented by formula (XIII) include Compounds A-1 to A-22 disclosed in JP-A-6-194790.

Of these compounds, ascorbic acid or erythorbic acid (optical isomer) (A-1) is preferred. The addition amount of the compound represented by formula (XIII) is from 0.03 to 0.12, preferably from 0.03 to 0.10, and particularly preferably from 0.05 to 0.09, of the concentration ratio of the compound represented by formula (XIII) to the hydroquinone developing agent.

A preservative for use in the developing solution of the development processing of the present invention is a free sulfite ion, which is added to the developing solution in the form of sodium sulfite, lithium sulfite, ammonium sulfite, or sodium bisulfite. The concentration of the free sulfite ion is from 0.3 to 1.2 mol/liter, preferably from 0.4 to 1.0 mol/liter, and particularly preferably from 0.5 to 0.8 mol/liter.

The pH of the developing solution for use in the development processing of the present invention is from 9.5 to 12, and preferably from 9.7 to 11.0. Examples of the alkali agents used for adjusting the pH include pH adjustors such as sodium hydroxide, sodium carbonate, sodium tertiary phosphate, potassium hydroxide and potassium carbonate.

It is preferred that borate which is usually used as a buffer should not be present in the developing solution because it forms a complex with the ascorbic acid derivative compound represented by formula (XIII).

Dialdehyde hardening agents or bisulfite addition products thereof may be used in the developing solution according to the present invention. Specific examples thereof include glutaraldehyde, α-methylglutaraldehyde, β-methylglutaraldehyde, maleindialdehyde, succindialdehyde, methoxysuccindialdehyde, methylsuccindialdehyde, α-methoxyβ-ethoxyglutaraldehyde, α-n-butoxyglutaraldehyde, α,α-diethylsuccindialdehyde, butylmaleindialdehyde, or bisulfite addition products of these compounds. Above all, glutaraldehyde or bisulfite addition product thereof is most generally used. Dialdehyde compound is used in such a degree of amount that the sensitivity of the photographic layer to be processed is not restrained and the drying time is not so prolonged. Specifically, the compound is used in an amount of from 1 g to 50 g, preferably from 3 g to 10 g, per liter of the developing solution.

Antifoggants, for example, indazole-based, benzimidazole-based or benzotriazole-based antifoggants, are used in the developing solution according to the present invention. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]butanesulfonate, and 5-amino-1,3,4-thiadiazole-2-thiol. The addition amount of these antifoggants is usually from 0.01 to 10 mmol, more preferably from 0.1 to 2 mmol, per liter of the developing solution. Halide compounds such as potassium bromide and sodium bromide can be used in addition to the above organic antifoggants.

Furthermore, various kinds of organic and inorganic chelating agents can be used in combination in the developing solution of the present invention. Examples of the inorganic chelating agents include sodium tetrapolyphosphate and sodium hexametaphosphate.

Examples of the organic chelating agents include organic carboxylic acid, aminopolycarboxylic acid, organic phosphonic acid, aminophosphonic acid, and organic phosphonocarboxylic acid.

Examples of the organic carboxylic acids include acrylic acid, oxalic acid, malonic acid, succinic acid, glutaric acid, adipic acid, pimelic acid, acielaidic acid, sebacic acid, nonanedicarboxylic acid, decanedicarboxylic acid, undecanedicarboxylic acid, maleic acid, itaconic acid, malic acid, citric acid, and tartaric acid, but the present invention is not limited thereto.

Examples of the aminopolycarboxylic acids include iminodiacetic acid, nitrilotriacetic acid, nitrilotripropionic acid, ethylenediaminemonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminetetraacetic acid, and compounds disclosed in JP-A-52-25632, JP-A-55-67747, JP-A-57-102624, and JP-B-53-40900.

Examples of the organic phosphonic acids include hydroxyalkylidene-diphosphonic acid disclosed in U.S. Pat. Nos. 3,214,454, 3,794,591 and West German Patent Publication No. 2,227,639, and compounds disclosed in *Research Disclosure*, Vol. 181, Item 18170 (May, 1979).

Examples of the aminophosphonic acids include aminotris(methylenephosphonic acid), ethylenediaminetetramethylenephosphonic acid, aminotrimethylenephosphonic acid, and compounds disclosed in *Research Disclosure*, No. 18170, JP-A-57-208554, JP-A-54-61125, JP-A-55-29883 and JP-A-56-97347.

Examples of the organic phosphonocarboxylic acids include compounds disclosed in JP-A-52-102726, JP-A-53-42730, JP-A-54-121127, JP-A-55-4024, JP-A-55-4025, JP-A-55-126241, JP-A-55-65955, JP-A-55-65956 and Research Disclosure, No. 18170.

These chelating agents may be used in the form of alkali metal salts or ammonium salts. The addition amount of these chelating agents is preferably from $1\times10^{-4}$ to $1\times10^{-1}$ mol, more preferably from $1\times10^{-3}$ to $1\times10^{-2}$ mol, per liter of the developing solution.

The developing solution for use in the present invention can contain various additives, if required, in addition to the above described components, for example, a buffer (e.g., carbonates, alkanolamines), an alkali agent (e.g., hydroxide, carbonate), an auxiliary solvent (e.g., polyethylene glycols, esters thereof), a pH adjustor (e.g., organic acids such as acetic acid), a development accelerator (e.g., pyridinium compounds and other cationic compounds, cationic dyes such as phenosafranine, neutral salts such as thallium nitrate and potassium nitrate as disclosed in U.S. Pat. No. 2,648,604, JP-B-44-9503, and U.S. Pat. No. 3,171,247; polyethylene glycol and derivatives thereof, nonionic compounds such as polythioethers as disclosed in JP-B-44-9304, U.S. Pat. Nos. 2,533,990, 2,531,832, 2,950,970 and 2,577,127; organic solvents as disclosed in JP-B-44-9509 and Belgian Patent 682,862; thioether based compounds as disclosed in U.S. Pat. No. 3,201,242, and thioether based compounds are particularly preferred of them), and a surfactant.

The development processing temperature and the development processing time are related reciprocally and determined in relationship with the total processing time, and generally the processing temperature is from about 20° C. to about 50° C. and the processing time is from 10 seconds to 2 minutes.

When $m^2$ of a silver halide black-and-white photographic material is processed, the replenishment rate of the developing solution is 300 ml or less and preferably 170 ml or less.

Fixing process is carried out succeeding to development process.

The fixing solution for use in the fixing process in the present invention is an aqueous solution containing sodium thiosulfate and ammonium thiosulfate, and if desired, tartaric acid, citric acid, gluconic acid, boric acid, and salts thereof. The pH of the fixing solution is, in general, from about 3.8 to about 7.0, preferably from 5.0 to 7.0, and particularly preferably from 5.2 to 6.0. Of the above components, the main fixing agent is sodium thiosulfate or ammonium thiosulfate. The addition amount of thiosulfate is from 0.5 to 2.0 mol/liter, preferably from 0.7 to 1.6 mol/liter, and particularly preferably from 1.0 to 1.5 mol/liter.

The fixing solution can include, if desired, a hardening agent (e.g., water-soluble aluminum compound), a preservative (e.g., sulfite, bisulfite), a pH buffer (e.g., acetic acid, boric acid), a pH adjustor (e.g., ammonia, sulfuric acid), a chelating agent, a surfactant, a wetting agent, and a fixing accelerator. Specific examples of the surfactants include anionic surfactants (e.g., sulfated product, sulfonated product), polyethylene surfactants, and amphoteric surfactants disclosed in JP-A-57-6840, and known defoaming agents can also be used. Specific examples of the wetting agents include alkanolamines and alkyl glycols. Specific examples of the fixing accelerators include thiourea derivatives disclosed in JP-B-45-35754, JP-B-58-122535 and JP-B-58-122536, alcohols having a triple bond in the molecule, thioether compounds disclosed in U.S. Pat. 4,126,459, mesoionic compounds disclosed in JP-A-4-229860. Specific examples of the pH buffer include an organic acid (e.g., acetic acid, malic acid, succinic acid, tartaric acid, citric acid), and an inorganic buffer (e.g., boric acid, phosphate, sulfite). Inorganic buffers are preferably used in the present invention from the viewpoint of the control of the odor and the generation of rust on the instrument. The pH buffer is used for preventing rising of pH of the fixing solution due to the carryover of the developing solution, and used in an amount of from 0.1 to 1.0 mol/liter, more preferably from 0.2 to 0.6 mol/liter.

It is preferred for the fixing solution for use in the present invention to use gluconic acid, iminodiacetic acid, glucoheptanoic acid, 5-sulfosalicylic acid, derivatives thereof, and salts thereof for the stabilization of the aluminum salt. The gluconic acid may be an anhydride having a lactone ring round it. Gluconic acid, iminodiacetic acid, alkali metal salts of these compounds, and ammonium salts of these compounds are particularly preferred of them. These compounds are used in one reagent type concentrated fixing solution substantially free of a boric compound in an amount of from 0.01 to 0.45 mol/liter and preferably from 0.03 to 0.3 mol/liter.

They may be used alone or in combination with one or more compounds. Furthermore, they are preferably used in the present invention in combination with the following compounds, for example, organic acids (e.g., malic acid, tartaric acid, citric acid, succinic acid, oxalic acid, maleic acid, glycolic acid, benzoic acid, salicylic acid, Tiron, ascorbic acid, glutaric acid, adipic acid), amino acids (e.g., aspartic acid, glycine, cysteine), aminopolycarboxylic acids (e.g., ethylenediaminetetraacetic acid, diethylenetriaminepentaacetic acid, 1,3-propanediaminetetraacetic acid, nitrilotriacetic acid), and saccharides.

Examples of the hardening agent in the fixing solution of the present invention include water-soluble aluminum and chromium salts. Preferred compounds are water-soluble aluminum salts, such as aluminum chloride, aluminum sulfate and potassium alum. The processing temperature is preferably from about 20° C. to about 50° C. and the processing time is preferably from 5 seconds to 1 minute. The replenishing rate of the fixing solution is 300 ml/m$^2$ or less and particularly preferably 170 ml/m$^2$ or less.

A photographic material is subjected to washing or stabilizing processing after being development processed and fixing processed, then dried. Washing or stabilizing processing can be carried out at a replenishing rate of 3 liters or less per m$^2$ of the silver halide photographic material (including zero, i.e., washing in a reservoir). That is, not only water saving processing can be carried out but also piping for installation of an automatic processor is not required.

As a means of reducing the replenishment rate of the washing water, a multistage countercurrent system (for example, two stages or three stages) has been known. If this multistage countercurrent system is applied to the present invention, the photographic material after fixation is gradually advanced to, contacted with and processed by processing solutions not contaminated with a fixing solution. Accordingly, more effective water washing can be carried out.

When washing is carried out with a reduced amount of water, it is preferred to use a washing tank equipped with a squeegee roller or a crossover roller disclosed in JP-A-63-18350 and JP-A-62-287252. The addition of various kinds of oxidizing agents and the provision of filters for filtration may be combined to reduce environmental pollution which becomes a problem when washing is carried out with a small amount of water.

In the above water saving processing without piping for installation of an automatic processor, washing or stabilizing solution is preferred to be provided with an antimicrobial means.

Various known antimicrobial means can be used in the present invention, such as ultraviolet irradiation method disclosed in JP-A-60-263939, method utilizing magnetic field disclosed in JP-A-60-263940, method of making pure water using an ion exchange resin disclosed in JP-A-61-131632, and methods of using microbicide disclosed in JP-A-62-115154, JP-A-62-153952, JP-A-62-220951 and JP-A-62-209532.

In addition, microbicide, fungicides, and surfactants disclosed in L. F. West, "Water Quality Criteria", *Photo. Sci. & Eng.*, Vol. 9, No. 6 (1965), M. W. Reach, "Microbiological Growths in Motion Picture Processing", *SMPTE Journal*, Vol. 85 (1976), R. O. Deegan, "Photo Processing Wash Water Biocides", *J. Imaging Tech.*, Vol. 10, No. 6 (1984), JP-A-57-8542, JP-A-57-56143, JP-A-58-105145, JP-A-57-132146, JP-A-58-18631, JP-A-57-97530 and JP-A-57-157244 can be used in combination.

Moreover, isothiazoline based compounds disclosed in R. T. Kreiman, *J. Imaging Tech.*, 10 (6), page 242 (1984), and compounds disclosed in *Research Disclosure*, Vol. 205, No. 20526 (No. 4, 1981) can be used in combination as a microbicide in a washing bath or a stabilizing bath.

In addition, compounds disclosed in Hiroshi Horiguchi, *Bohkin Bohbai no Kagaku* (*Antibacterial and Antifungal Chemistry*), Sankyo Shuppan K.K. (1982), *Bohkin Bohbai Gijutsu Handbook* (*Handbook of Antibacterial and Antifungal Technology*, edited by Nippon Bohkin Bohbai Gakkai, published by Hakuhodo (1986), may be contained in a washing water or a stabilizing solution.

When washing processing is carried out with a reduced amount of water, the constitution of the washing step as disclosed in JP-A-63-143548 is preferably used in the present invention.

Further, all or a part of the overflow generated from the washing tank or the stabilizing tank by the replenishment of the water applied with an antimold means by the method according to the present invention to the washing tank or the stabilizing tank in proportion to the progress of the processing can be utilized in the preceding processing step, i.e., a processing solution having a fixing ability as disclosed in JP-A-60-235133.

The processing solutions for use in the present invention are preferably preserved in the packaging materials of low oxygen permeation as disclosed in JP-A-61-73147.

On the other hand, in the case when the replenishment rate is reduced, it is preferred to prevent evaporation and air oxidation of the solution by minimizing the area of contact of the solution with the air in the processing tank. A roller transporting type automatic processor is disclosed in U.S. Pat. Nos. 3,025,779 and 3,545,971, and a roller transporting type processor comprising four steps of development, fixation, washing and drying is preferably used in the present invention.

The above processing solutions may be made into solid processing agents.

The solid processing agents which are preferably used in the present invention are powders, tablets, granules, lumps or paste, and preferred forms are the forms disclosed in JP-A-61-259921 or tablets. The methods for producing tablets disclosed in JP-A-51-61837, JP-A-54-155038, JP-A-52-88025 and British Patent 1,213,808 can be applied to the present invention, and granules can be produced by the ordinary methods disclosed, for example, in JP-A-2-109042, JP-A-2-109043, JP-A-3-39735 and JP-A-3-39739. Further, powder processing agents can be produced according to the ordinary methods disclosed in JP-A-54-133332, British Patents 725,892, 729,862 and German Patent 3,733,861.

The bulk density of the solid processing agents of the present invention is preferably from 0.5 to 6.0 g/cm$^3$, particularly preferably from 1.0 to 5.0 g/cm$^3$ from the viewpoint of solubility and the effect of the present invention.

In the development processing of the present invention, the developing time is from 5 seconds to 3 minutes, preferably from 8 seconds to 2 minutes, and the developing temperature is preferably from 18° C. to 50° C., more preferably from 24° C. to 40° C.

The fixing is preferably carried out at about 18° C. to about 50° C. for 5 seconds to 3 minutes, more preferably at 24° C. to 40° C. for 6 seconds to 2 minutes. Sufficient fixation can be conducted within this range and sensitizing dyes can be dissolved out in such a degree that remaining color is not generated.

The washing (or stabilizing) is preferably carried out at 5° to 50° C. for 6 seconds to 3 minutes, more preferably at 15° to 40° C. for 8 seconds to 2 minutes.

Photographic materials having been developed, fixed and washed (or stabilized) are dried after the water content is squeezed out of the materials, that is, through squeegee rollers. Drying is carried out at about 40° C. to 100° C., and the drying time can be varied arbitrarily depending on the circumferential conditions but is generally from about 4 seconds to 3 minutes and particularly preferably at 40° C. to 80° C. for about 5 seconds to 1 minute.

When development processing is carried out by rapid development processing of dry to dry of 100 seconds or less, to avoid the development unevenness peculiar to rapid processing, it is preferred that the rubber rollers disclosed in JP-A-63-151943 are provided at the outlet of the developing tank, the discharge flow rate for stirring the developing solution in the developing tank is set at 10 m/min or more as disclosed in JP-A-63-151944, and that stirring at least during development processing is stronger than during waiting as disclosed in JP-A-63-264758. It is preferred for rapid processing that, in particular, the constitution of the rollers in the fixing tank is opposed rollers to increase the fixing speed. The number of rollers can be reduced by adopting this opposed roller structure, as a result, the size of the processing tank can be reduced. That is, it becomes feasible to miniaturize the automatic processor.

The present invention is described in detail with reference to the following examples, but it should not be construed as being limited thereto.

EXAMPLE 1

Preparation of Emulsion

Specimen 1

A reaction vessel which contained 24 g per mol of Ag of gelatin and 780 ml per mol of Ag of water was prepared. To this solution which was maintained at 46° C., 0.015 g per mol of Ag of a silver halide solvent (shown in Table 1) and the compound represented by formula (I), (II) or (III) (shown in Table 1) were added and the solution was stirred for 5 minutes. A solution containing 1.6M silver nitrate and a solution containing 1.7M KBr were added thereto at the same time each in an amount of 11.4 ml. Subsequently, a 0.5% aqueous solution containing 0.02 g of $(NH_4)_2Rh(H_2O)C_5$ was added to the mixed solution, then the above silver nitrate solution and KBr solution were added to the reaction vessel at the same time over 50 minutes until the total addition amount of Ag reached 1 mol while maintaining pAg at 7.90, thereby $5\times10^{-5}$ mol per mol of silver of $(NH_4)_2Rh(H_2O)Cl_5$ was contained in a grain.

Subsequently, 50 g per mol of Ag of desalted gelatin was added to the reaction mixture and the pH was adjusted to 6.5 with NaOH. The grain size of the obtained emulsion was 0.18 μm (cubic edge). (variation coefficient: 12%)

Specimen 2

An emulsion was prepared in the same manner as in Specimen 1, except that doping was conducted using 0.015 g of $K_2IrBr_6$.

Specimen 3

An emulsion was prepared in the same manner as in Specimen 1, except that doping was conducted using 0.012 g of $K_2Ru(NO)Cl_5$.

Specimen 4

An emulsion was prepared in the same manner as in Specimen 1, except for carrying out doping such that a 0.5% aqueous solution containing 0.02 g of $(NH_4)_2Rh(H_2O)Cl_5$ was mixed with a solution containing 1.7M KBr and this mixed solution and a solution containing 1.6M $AgNO_3$ were added to the reaction vessel at the same time to conduct doping uniformly in the grain.

Specimen 5

An emulsion was prepared in the same manner as in Specimen 1, except that doping was conducted using 2 g of $(NH_4)_2Rh(H_2O)Cl_5$.

Specimen 6

An emulsion was prepared in the same manner as in Specimen 1, except that doping was conducted using 1.5 g of $K_2IrBr_6$.

Specimen 7

An emulsion was prepared in the same manner as in Specimen 1, except that doping was conducted using $2\times10^{-5}$ g of $(NH_4)_2Rh(H_2O)Cl_5$.

Preparation of Coating Solutions for Emulsion Layers Containing Emulsions 1 to 20 and Coating Thereof The above emulsions were finished as follows. To the emulsions described in Specimens 1 to 7, 0.20 g per mol of silver of silver nitrate was added, and fogging was conducted using 0.02 g of thiourea dioxide at 65° C. for 90 minutes. The pAg was adjusted with phosphoric acid to 7.5, and a preservative was added thereto to finish Emulsions 1 to 20 as shown in Tables 1 and 2.

The following compounds were added to Emulsions 1 to 20 shown in Tables 1 and 2 and each silver halide emulsion layer was coated on the following support having an undercoat layer each in a gelatin coating amount of 1.6 g/m² and a silver coating amount of 2.7 g/m².

Compound C 2.5 mg/m²

Compound G 28 mg/m²

Compound H 1.6 mg/m²

Compound I 1.9 mg/m²

Compound J 16 mg/m²

Compound K 36 mg/m²

Compound L 240 mg/m²

Lower and upper emulsion protective layers were coated as upper layers on the above emulsion layer.

Preparation of Coating Solution for Lower Emulsion Protective Layer and Coating Thereof The following compounds were added to an aqueous solution of gelatin and the lower emulsion protective layer was coated on the above emulsion layer in a gelatin coating amount of 1.1 g/m².

Gelatin 1.1 g/m²

Compound D 58 mg/m²

Compound E 40 mg/M²

Compound F 156 mg/m²

Compound M 16 mg/m²

Glacial Acetic Acid 5.5 mg/m²

Compound N 24 mg/M²

KBr 16 mg/M²

Compound L 290 mg/m²

Compound P 130 Mg/m²

Compound Q 43 mg/m²

Preparation of Coating Solution for Upper Emulsion Protective Layer and Coating Thereof The following compounds were added to an aqueous solution of gelatin and the upper emulsion protective layer was coated on the above emulsion layer in a gelatin coating amount of 0.4 g/m².

Gelatin 0.4 g/m²

Amorphous Silica Matting Agent 38 mg/M² (particle size: 3 to 4 μm)

Compound N 25 mg/m²

Compound U 3 mg/m²

Compound V 20 mg/m²

Compound K 5 mg/m²

The following electrically conductive layer and backing layer were coated on the opposite side of the support simultaneously.

Preparation of Coating Solution for Electrically Conductive Layer and Coating Thereof The following compounds were added to an aqueous solution of gelatin and the electrically conductive layer was coated on the above support in a gelatin coating amount of 76 mg/M².

$SnO_2$/Sb (9/1 in weight ratio, 188 mg/m² average particle size: 0.25 μm)

Gelatin 76 mg/m$^2$

Compound J 13 mg/$^2$

Compound N 15 mg/M$^2$

Compound K 12 mg/M$^2$

Preparation of Coating Solution for Backing Layer and Coating Thereof

The following compounds were added to an aqueous solution of gelatin and the backing layer was coated on the above support in a gelatin coating amount of 2.8 g/m$^2$.

Gelatin 2.8 g/m$^2$

Polymethyl Methacrylate Fine Particles 15 mg/M$^2$ (average particle size: 1.5 μm)

Compound R 175 mg/m$^2$

Compound E 74 mg/m$^2$

Compound G 49 mg/m$^2$

Compound S 41 mg/m$^2$

Compound J 25 mg/m$^2$

Compound N 55 mg/m$^2$

Compound T 5 mg/m$^2$

Glacial Acetic Acid 13 mg/m$^2$

Compound U 10 mg/m$^2$

Sodium Sulfate 228 mg/m$^2$

Compound K 20 mg/m$^2$

Compound P 102 mg/m$^2$

Compound Q 34 mg/m$^2$

Support and Undercoat Layer

On both sides of a biaxially stretched polyethylene terephthalate support having a thickness of 100 μm, the first and second undercoat layers having the following compositions were coated.

First Undercoat Layer

Core/Shell Type Vinylidene Chloride (1) 15 g 2,4-Dichloro-6-hydroxy-s-triazine 0.25 g Polystyrene Fine Particles 0.05 g (average particle size: 3 μm)

Compound W 0.20 g

Colloidal Silica (Snowtex Z ZL 0.12 g (particle size: 70 to 100 μm) (produced by Nissan Chemical Industries, Ltd.)

Water to make 100 g

The coating solution whose pH was adjusted with 10 wt % of KOH to 6 was coated on the support at the drying temperature of 180° C. for 2 minutes so that the dried film thickness reached 0.9 μm.

Second Undercoat Layer

Gelatin 1 g

Methyl Cellulose 0.05 g

Compound X 0.02 g $C_{12}H_{25}O(CH_2CH_2O)_{10}H$ 0.03 g

Compound Y $^{3.5\times10-3}$ g

Acetic Acid 0.2 g

Water to make 100 g

The coating solution was coated on the support at the drying temperature of 170° C. for 2 minutes so that the dried film thickness reached 0.1 μm. Thus, Sample Nos. 1 to 17 were prepared.

Compound C

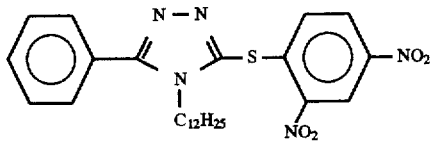

Compound D

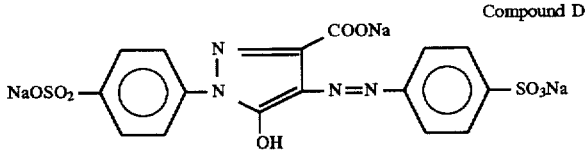

Compound E

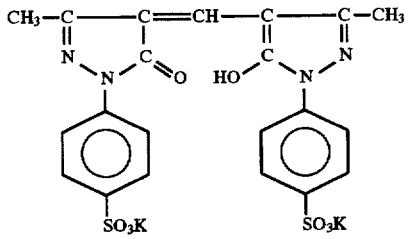

Compound F

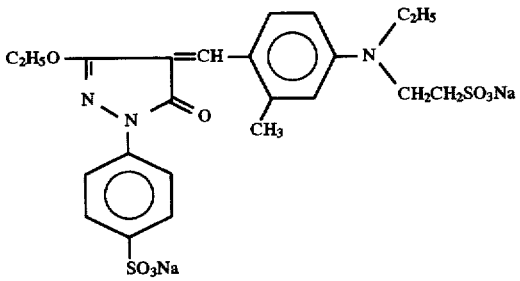

Compound G

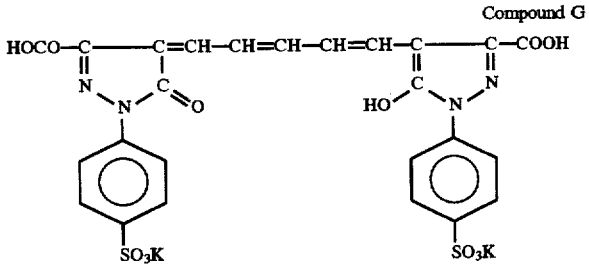

Compound H

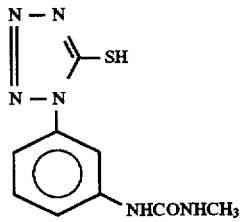

Compound I

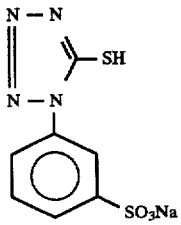

-continued

Compound J

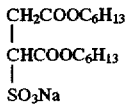

Compound K

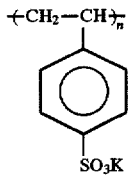

Compound L

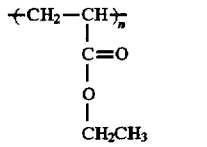

Compound M

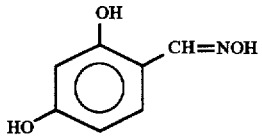

Compound N

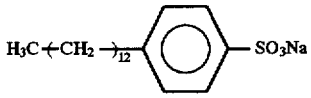

Compound P

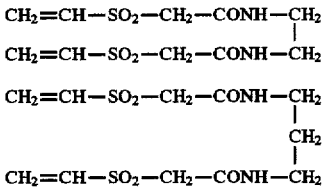

Compound Q

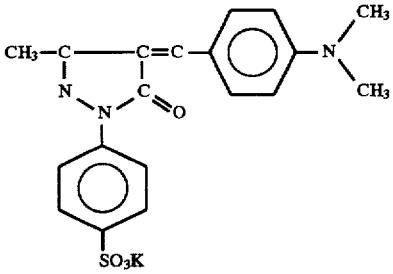

Compound R

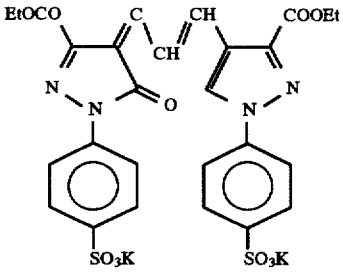

Compound S $C_8F_{17}SO_3Li$

Compound T $C_8F_{17}SO_2NCH_2COOK$

Compound U

-continued

Compound V

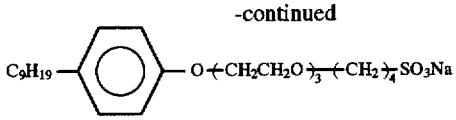

Core/Shell Type Vinylidene Chloride Copolymer

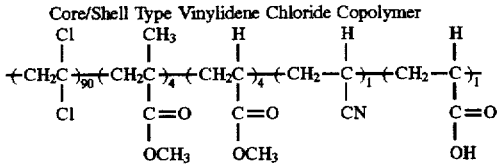

VDC MMA MA AN AA

Core: VDC/MMA/MA (80 wt %)
Shell: VDC/AN/AA (20 wt %)
Average grain size: 70 nm

Compound W

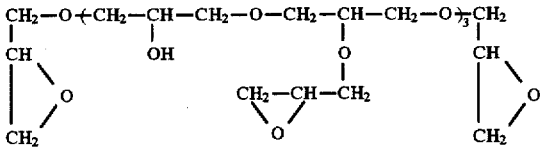

Compound X

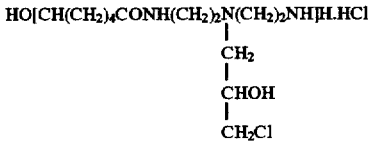

Compound Y

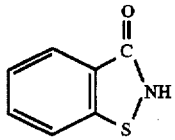

Compound Z

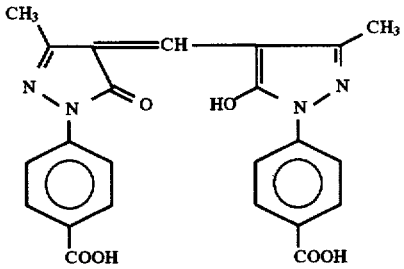

Evaluation

The thus-obtained samples were subjected to exposure for sensitometry through a step wedge with P627 type printer manufactured by Dai Nippon Screen Mfg. Co., Ltd., then underwent development, fixing, washing and drying processes and evaluated for storage stability and Dmin of the processed materials. Herein, storage stability means the width of sensitization of the sensitivity at density 1.5 after aging for three days at 50° C., 75% RH, and practical Dmin means Dmin measured at exposure giving contact ratio of 1/1 of 175 line 50% square dot.

This development processing was conducted with FG460A automatic processor (produced by Fuji Photo Film Co., Ltd.) using Developing Solution 1 as the developing solution and Fixing Solution 1 as the fixing solution. This automatic processor uses the development processing system of replenishing 200 ml of the developing replenisher per $m^2$ of a silver halide photographic material processed. (Development was conducted at 38° C. for 20 seconds.)

Developing Solution 1
Potassium Hydroxide 42.0 g
Sodium Metabisulfite 86.3 g
Diethylenetriaminepentaacetic Acid 3.3 g
5-Methylbenzotriazole 0.20 g
Sodium 2-Mercaptobenzimidazole-5-sulfonate.$2H_2O$ 0.36 g

TABLE 2

| Sample No. | Emulsion | Silver Halide Solvent | Compound of Formula (I), (II) or (III) | Formulation | Storage Stability $\Delta S_{1.5}$ | Practical Dmin | Remarks |
|---|---|---|---|---|---|---|---|
| 14 | 14 | 4–2 | 1–16 | Specimen 1 | 0.03 | 0.04 | Invention |
| 15 | 15 | " | " | Specimen 2 | 0.03 | 0.04 | Invention |
| 16 | 16 | " | " | Specimen 3 | 0.02 | 0.04 | Invention |
| 17 | 17 | " | " | Specimen 4 | 0.03 | 0.15 | Comparison |
| 18 | 18 | " | " | Specimen 5 | 0.03 | 0.09 | Comparison |
| 19 | 19 | " | " | Specimen 6 | 0.04 | 0.08 | Comparison |
| 20 | 20 | " | " | Specimen 7 | 0.04 | 0.09 | Comparison |

KBr 4.1 g
Potassium Carbonate 77 g
Hydroquinone 50 g
4-Hydroxymethyl-4-methyl-1-phenyl-3-pyrazolidone 0.68 g
Sodium Erythorbate 7.7 g
Diethylene Glycol 6.3 g
pH (adjusted with potassium hydroxide) 10.45
Water to make 1 liter Fixing Solution 1
Ammonium Thiosulfate 119.7 g
Disodium Ethylenediaminetetraacetate Dihydrate 0.03 g
Sodium Thiosulfate Pentahydrate 10.9 g
Sodium Sulfite 25.0 g
NaOH 12.4 g
Glacial Acetic Acid 29.1 g
Tartaric Acid 2.92 g
Sodium Gluconatet 1.74 g
Aluminum Sulfate 8.4 g
pH (adjusted with sulfuric acid or sodium hydroxide) 4.8
Water to make 1 liter Coated samples used and the results of evaluation are shown in Tables 1 and 2.

TABLE 1

| Sample No. | Emulsion | Silver Halide Solvent | Compound of Formula (I), (II) or (III) | Formulation | Storage Stability $\Delta S_{1.5}$ | Practical Dmin | Remarks |
|---|---|---|---|---|---|---|---|
| 1 | 1 | — | 1–2 | Specimen 1 | 0.02 | 0.05 | Comparison |
| 2 | 2 | — | 1–6 | " | 0.03 | 0.05 | Comparison |
| 3 | 3 | 4–1 | — | " | 0.11 | 0.07 | Comparison |
| 4 | 4 | " | 1–2 | " | 0.03 | 0.04 | Invention |
| 5 | 5 | " | 1–16 | " | 0.03 | 0.04 | Invention |
| 6 | 6 | 4–2 | — | " | 0.10 | 0.06 | Comparison |
| 7 | 7 | " | 1–2 | " | 0.03 | 0.04 | Invention |
| 8 | 8 | " | 1–6 | " | 0.01 | 0.04 | Invention |
| 9 | 9 | " | 1–16 | " | 0.03 | 0.04 | Invention |
| 10 | 10 | " | 1–21 | " | 0.02 | 0.04 | Invention |
| 11 | 11 | 4–3 | — | " | 0.11 | 0.06 | Comparison |
| 12 | 12 | " | 1–2 | " | 0.02 | 0.04 | Invention |
| 13 | 13 | " | 1–16 | " | 0.02 | 0.04 | Invention |

As is apparent from Tables 1 and 2, both of excellent storage stability and low practical Dmin were obtained according to the present invention.

EXAMPLE 2

Preparation of emulsions, preparation of coating solutions for emulsion layers and coating thereof, preparation of electrically conductive layers, a support, coating solutions for undercoat layers and coating thereof, and evaluations were conducted in the same manner as in Example 1, and others were carried out as follows. However, practical Dmin was evaluated by measuring the density of five sheets overlapped.

Preparation of Coating Solution for Lower Emulsion Protective Layer and Coating Thereof The following compounds were added to an aqueous solution of gelatin and the lower emulsion protective layer was coated on the emulsion layer in a gelatin coating amount of 1.1 g/$m^2$.

Gelatin 1.1 g/m$^2$
Compound D 52 mg/m$^2$
Compound F 156 mg/m$^2$
Compound M 16 mg/m$^2$
Glacial Acetic Acid 6.2 mg/m$^2$
Compound N 24 mg/m$^2$
KBr 16 mg/m$^2$
Compound L 290 mg/M$^2$
Compound P 130 mg/m$^2$
Compound Q 43 mg/m$^2$ Preparation of Coating Solution for Upper Emulsion Protective Layer and Coating Thereof The following compounds were added to an aqueous solution of gelatin and the upper emulsion protective layer was coated on the emulsion layer in a gelatin coating amount of 0.4 g/m$^2$.

Gelatin 0.4 g/M$^2$
Amorphous Silica Matting Agent (particle size: 3 to 4 μm) 38 mg/m$^2$
Compound Z 50 mg/m$^2$
Compound N 25 mg/m$^2$
Compound U 3 mg/m$^2$
Compound V 20 mg/M$^2$
Compound K 5 mg/M$^2$ Preparation of Coating Solution for Backing Layer and Coating Thereof The following compounds were added to an aqueous solution of gelatin and the backing layer was coated on the support in a gelatin coating amount of 2.8 g/m$^2$.

Gelatin 2.8 g/m$^2$
Polymethyl Methacrylate Fine Particles (average particle size: 4.5 μm) 15 mg/M$^2$
Compound R 183 mg/m$^2$
Compound E 74 mg/m$^2$
Compound G 49 mg/M$^2$
Compound S 41 mg/m$^2$
Compound J 25 mg/m$^2$
Compound N 55 mg/M$^2$
Compound T 5 mg/m$^2$
Glacial Acetic Acid 13 mg/M$^2$
Compound U 10 mg/M$^2$
Sodium Sulfate 228 mg/m$^2$
Compound K 20 mg/m$^2$
Compound P 102 mg/m$^2$
Compound Q 34 mg/m$^2$ Coating formulation used and the results obtained are shown in Table 3 below.

TABLE 3

| Sample No. | Emulsion | Silver Halide Solvent | Compound of Formula (I), (II) or (III) | Formulation | Coating Formulation | Storage Stability $\Delta S_{1.5}$ | Practical Dmin (5 sheets overlapped) |
|---|---|---|---|---|---|---|---|
| 21 | 14 | 4–2 | 1–16 | Specimen 1 | Example 1 | 0.03 | 0.23 |
| 22 | 14 | " | " | Specimen 1 | Example 2 | 0.03 | 0.19 |
| 23 | 15 | " | " | Specimen 2 | Example 1 | 0.03 | 0.22 |
| 24 | 15 | " | " | Specimen 2 | Example 2 | 0.03 | 0.20 |
| 25 | 16 | " | " | Specimen 3 | Example 1 | 0.03 | 0.23 |
| 26 | 16 | " | " | Specimen 3 | Example 2 | 0.02 | 0.20 |

As is shown in Table 3, more excellent storage stability and lower practical Dmin than those in Example 1 were obtained using the solid dispersion dye.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having at least one pre-fogged direct positive emulsion layer on at least one side of the support, wherein silver halide grain formation of the emulsion is carried out in the presence of a silver halide solvent, the emulsion contains at least one of an Rh salt, an Ru salt and a polybromoiridium salt, and at least one compound selected from the group consisting of compounds represented by the following formulae (I), (II) and (III) is added to the emulsion while the silver halide photographic material is prepared:

$$R—SO_2S—M \quad (I)$$

$$R—SO_2S—R^1 \quad (II)$$

$$R—SO_2S—L_m—SSO_2—R^2 \quad (III)$$

wherein R, $R^1$ and $R^2$ are the same or different, and each represents an aliphatic group, an aromatic group or a heterocyclic group;

M represents a cation;

L represents a divalent linking group; and m represents 0 or 1.

2. The silver halide photographic material as claimed in claim 1, wherein at least one of the Rh salt, the Ru salt and the polybromoiridium salt is contained in the emulsion in an amount of from $10^{-6}$ to $10^{-4}$ mol/mol Ag.

3. The silver halide photographic material as claimed in claim 2, wherein 90% of the Rh salt, the Ru salt and the polybromoiridium salt are added to the emulsion before 5% of the total silver amount used during the grain formation are added.

4. The silver halide photographic material as claimed in claim 1, wherein the pre-fogged direct positive emulsion layer is provided on the support, and a layer containing a solid dispersion dye is further provided on the pre-fogged direct positive emulsion layer.

* * * * *